US008398415B1

(12) United States Patent
Jetton

(10) Patent No.: US 8,398,415 B1
(45) Date of Patent: Mar. 19, 2013

(54) CONNECTOR ASSEMBLY FOR ASSEMBLING/DISASSEMBLING FOUR CONNECTORS USING A STAGED-RELEASE MEMBER

(75) Inventor: James T. Jetton, Ann Arbor, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 13/300,061

(22) Filed: Nov. 18, 2011

(51) Int. Cl.
*H01R 13/44* (2006.01)

(52) U.S. Cl. ..... 439/144

(58) Field of Classification Search ..... 439/144, 439/352–355, 181, 345
See application file for complete search history.

(56) References Cited

U.S. PATENT DOCUMENTS

| | | | | |
|---|---|---|---|---|
| 4,867,699 | A * | 9/1989 | Oda et al. | 439/355 |
| 5,147,988 | A | 9/1992 | Appleton | |
| 6,059,595 | A | 5/2000 | Lacrouts-Cazenave | |
| 6,325,648 | B1 | 12/2001 | Bilezikjian et al. | |
| 6,491,532 | B1 | 12/2002 | Schoepf et al. | |
| 6,648,669 | B1 | 11/2003 | Kim et al. | |
| 6,666,698 | B2 * | 12/2003 | Beck et al. | 439/181 |
| 6,746,258 | B2 | 6/2004 | Kikuchi et al. | |
| 6,767,570 | B2 | 7/2004 | Zukerman et al. | |
| 6,918,800 | B2 | 7/2005 | Ota et al. | |
| 6,926,547 | B2 | 8/2005 | Schoepf et al. | |
| 7,217,150 | B2 * | 5/2007 | Lekic et al. | 439/352 |
| 7,300,313 | B1 | 11/2007 | Whiteman, Jr. et al. | |
| 7,500,869 | B2 | 3/2009 | Wang | |
| 7,544,074 | B2 * | 6/2009 | Buck et al. | 439/144 |
| 7,934,939 | B2 * | 5/2011 | Chen et al. | 439/352 |
| 7,946,871 | B1 | 5/2011 | Yu et al. | |
| 2008/0274628 | A1 | 11/2008 | Chauvelier et al. | |
| 2010/0041266 | A1 | 2/2010 | Data et al. | |

OTHER PUBLICATIONS

Hot Swapping, http://en.wikipedia.org/wiki/Hot-swapping, Dec. 17, 2011.

* cited by examiner

*Primary Examiner* — Chandrika Prasad
(74) *Attorney, Agent, or Firm* — Harness, Dickey & Pierce, P.L.C.

(57) ABSTRACT

An assembly may include a first connector, a second connector, a third connector, a fourth connector, and a staged-release member. The second connector may be configured to matingly engage the first connector. The fourth connector may be configured to matingly engage the third connector. The staged-release member may include first and second portions. The first portion may be secured relative to the first and third connectors. The second portion may be movable relative to the first portion between a first position restricting axial separation of the second connector from the first connector and a second position allowing axial separation of the second connector from the first connector. The fourth connector may restrict movement of the second portion from the first position to the second position while the fourth connector is matingly engaged with the third connector.

22 Claims, 8 Drawing Sheets

CONNECTOR ASSEMBLY FOR ASSEMBLING/DISASSEMBLING FOUR CONNECTORS USING A STAGED-RELEASE MEMBER

FIELD

The present disclosure relates to a connector assembly.

BACKGROUND

This section provides background information related to the present disclosure and is not necessarily prior art.

An electrical device may receive electrical power from a power source (e.g., a battery) and one or more signals from one or more peripheral devices (e.g., a control device, a sensor, and/or a communication device). First and second power connectors may be utilized to connect the electrical device to the power source for electrical communication therebetween. First and second signal connectors may be utilized to connect the electrical device to the one or more peripheral devices for electrical communication therebetween. In some circumstances, disconnecting the power connectors from each other prior to disconnecting the signal connectors from each other can result in electrical arcing across the power connectors, which can damage the connectors and/or the electrical device. Therefore, it may be desirable to disconnect the signal connectors from each other prior to disconnecting the power connectors from each other to break a signal circuit before breaking a power circuit to reduce a risk of arcing across the power connectors.

SUMMARY

This section provides a general summary of the disclosure, and is not a comprehensive disclosure of its full scope or all of its features.

In one form, the present disclosure provides an assembly that may include a first connector, a second connector, a third connector, a fourth connector, and a staged-release member. The second connector may be configured to matingly engage the first connector. The fourth connector may be configured to matingly engage the third connector. The staged-release member may include first and second portions. The first portion may be secured relative to the first and third connectors. The second portion may be movable relative to the first portion between a first position restricting axial separation of the second connector from the first connector and a second position allowing axial separation of the second connector from the first connector. The fourth connector may restrict movement of the second portion from the first position to the second position while the fourth connector is matingly engaged with the third connector.

In another form, the present disclosure provides a device for ensuring a sequenced disconnection of an electrical connector assembly. The electrical connector assembly may include first and second connectors adapted to engage third and fourth connectors, respectively. The device may include a first portion and a second portion. The first portion may include a body and first and second engagement features extending from the body. The first and second engagement features may be adapted to removably engage the first and second connectors, respectively. The second portion may be connected to the first portion and may include a first stop member and a second stop member. The first stop member may be movable relative to the first portion between a first position restricting axial separation of the third connector from the first connector and a second position allowing axial separation of the third connector from the first connector. The second stop member may be configured to restrict movement of the first stop member from the first position to the second position while the fourth connector is matingly engaged with the second connector.

In yet another form, the present disclosure provides a method that may include coupling first and second connectors to facilitate electrical communication between first and second electrical conductors housed within the first and second connectors, respectively. The method may also include coupling third and fourth connectors to facilitate electrical communication between third and fourth electrical conductors housed within the third and fourth connectors, respectively. A staged-release member may be coupled to the first and third connectors. The fourth connector may be axially separated from the third connector. At least a portion of the staged-release member may be moved relative to the second connector from a first position to a second position after axially separating the fourth connector from the third connector. The second connector may be axially separated from the first connector after at least the portion of the staged-release member is moved to the second position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
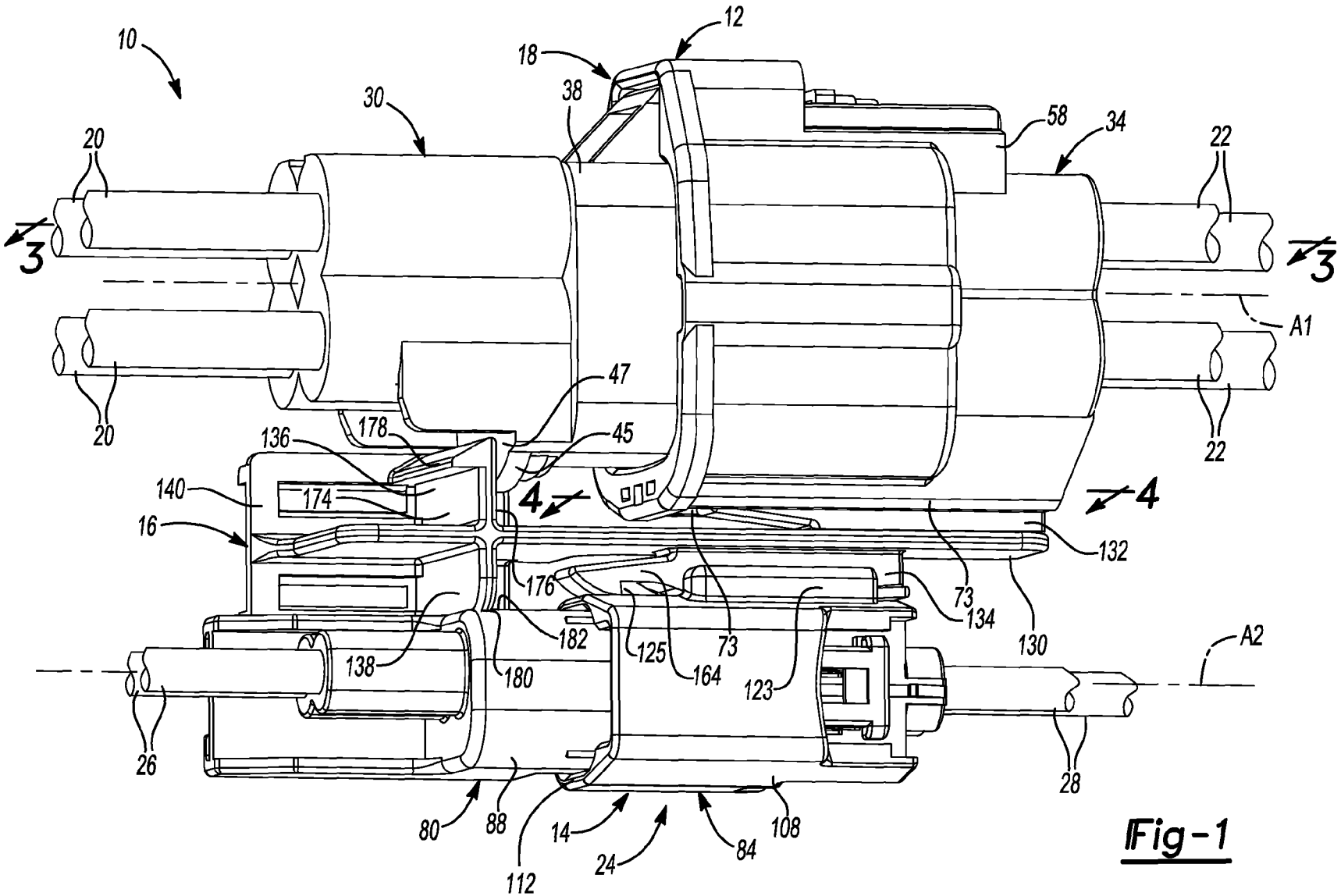
FIG. 1 is a perspective view of an assembly including a pair of connector assemblies and a staged-release member constructed in accordance with the teachings of the present disclosure.

An example embodiment will now be described more fully with reference to the accompanying drawings.

An example embodiment is provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that the example embodiment may be embodied in many different forms and that neither should be construed to limit the scope of the disclosure. Well-known processes, well-known device structures, and well-known technologies may not be described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an assembly constructed in accordance with the teachings of the present disclosure is generally indicated by reference numeral 10. The assembly 10 can include a first connection 12, a second connection 14, and a staged-release member 16. The first connection 12 can include a first connector assembly 18, one or more first insulated wires 20, and one or more second insulated wires 22. The first connector assembly 18 may engage and electrically connect the first and second insulated wires 20, 22 for electrical communication therebetween. The second connection 14 can include a second connector assembly 24, one or more third insulated wires 26, and one or more fourth insulated wires 28. The second connector assembly 24 may engage and electrically connect the third and fourth insulated wires 26, 28 for electrical communication therebetween.

Figure 3:
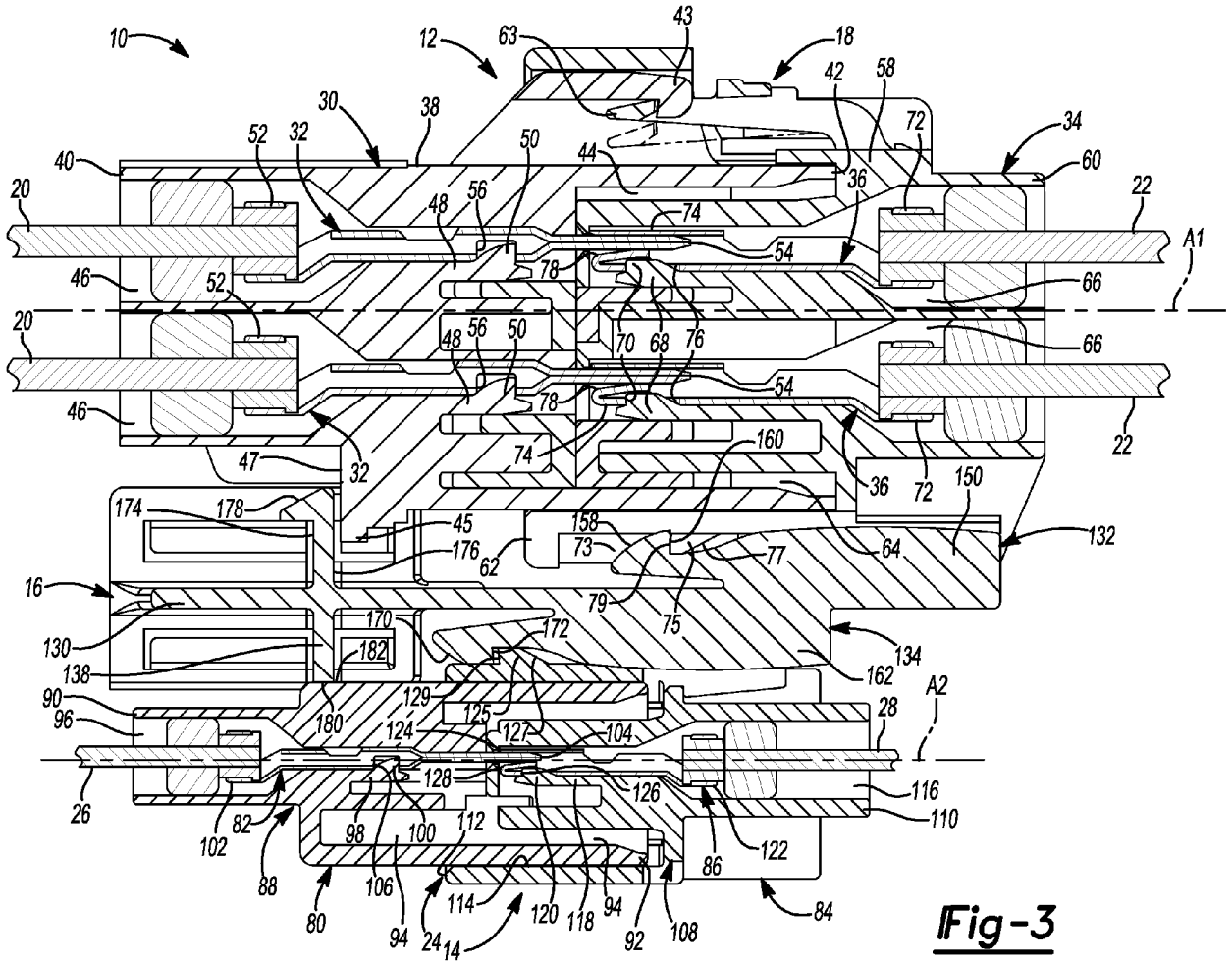
FIG. 3 is a cross-sectional view of the assembly taken along the line 3-3 of FIG. 1.

With reference to FIG. 3, the first connector assembly 18 can include a first connector 30, one or more first terminals 32, a second connector 34, and one or more second terminals 36. The first and second connectors 30, 34 may be disposed along a first engagement axis A1 and may engage each other by a snap or press fit, for example.

The first connector 30 can be a male power connector such as a YES/YESC Kaizen Connector sold by Yazaki North America, Inc. under the model number 7282-5595-10, for example, or any other suitable connector. The first connector 30 may be formed from a thermoplastic material, for example, and may include a body 38 having a first end 40, a second end 42, a first latch member 43 and a lip member 45. The first latch member 43 and the lip member 45 may be disposed between the first and second ends 40, 42. The lip member 45 may include an abutment surface 47 that is perpendicular to the first engagement axis A1 and faces away from the second connector 34. The body 38 may also include a recess 44 extending from the second end 42 toward the first end 40. One or more receptacles 46 may extend through the body 38 in a direction substantially parallel to the first engagement axis A1 from the first end 40 through to the recess 44. Each receptacle 46 may be partially defined by a resiliently flexible lock arm 48 having a barbed portion 50.

The first terminals 32 can be male terminals of the type sold by Yazaki North America, Inc. under the model number 7114-4140-02, for example, or any other suitable terminal. The first terminals 32 may be electrically conductive members including a first end 52, a second end 54, and a notch 56 disposed between the first and second ends 52, 54. The first end 52 of each first terminal 32 may be electrically coupled to a corresponding one of the first insulated wires 20 for electrical communication therebetween. The first terminals 32 may be received in the receptacles 46 such that the barbed portion 50 of each lock arm 48 engages the notch 56 of the corresponding terminal 32 via a snap fit to fixedly but releasably couple the first terminals 32 to the body 38. The second end 54 of the first terminals 32 may extend out of the receptacles 46 into the recess 44.

The second connector 34 can be a female power connector such as a YES/YESC Kaizen Connector sold by Yazaki North America, Inc. under the model number 7283-5595-10, for example, or any other suitable connector. The second connector 34 may be formed from a thermoplastic material, for example, and may include a body 58 having a first end 60, a second end 62, and a second latch member 63 disposed between the first and second ends 60, 62. The body 58 may include a recess 64 extending from the second end 62 toward the first end 60. One or more receptacles 66 may extend through the body 58 in a direction substantially parallel to the first engagement axis A1 from the first end 60 through to the recess 64. Each receptacle 66 may be partially defined by a resiliently flexible lock arm 68 having a barbed portion 70.

Figure 4:
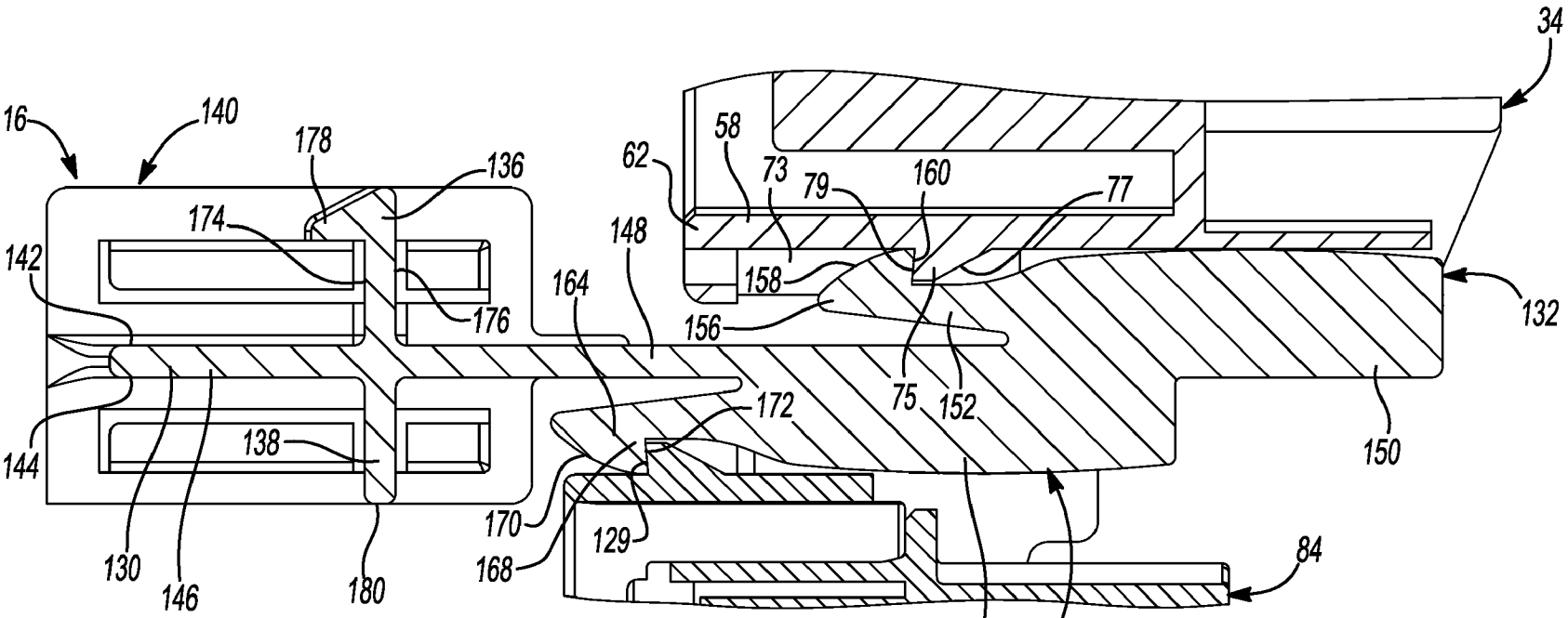
FIG. 4 is a partial cross-sectional view of the assembly taken along the line 4-4 of FIG. 1.
Figure 5:
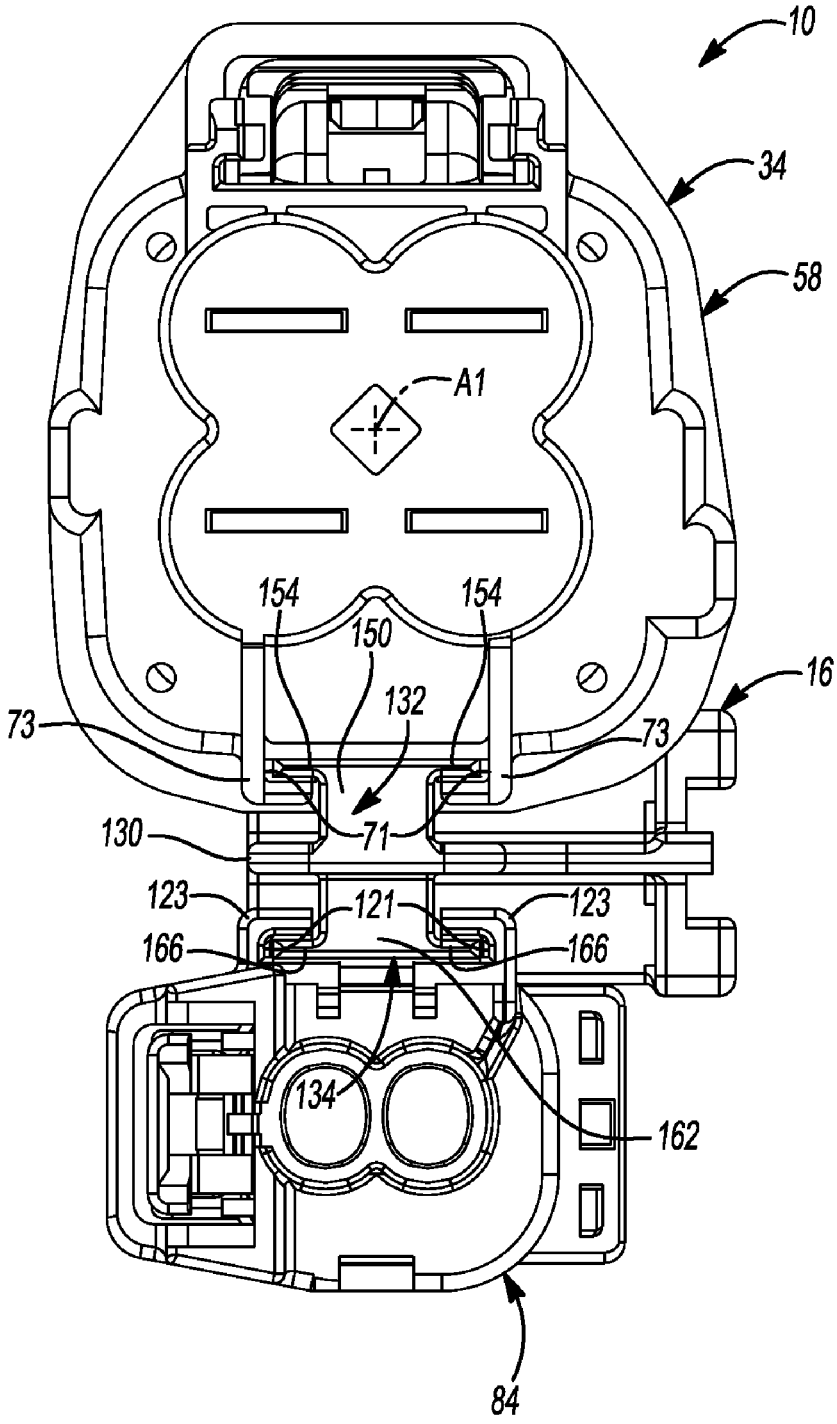
FIG. 5 is an end view of the assembly of FIG. 1.

As shown in FIGS. 3-5, the body 58 of the second connector 34 may also include a pair of ribs 73 that may extend parallel to each other and parallel to the first engagement axis A1. Each of the ribs 73 may include a slot 71 (shown in FIG. 5) formed therein that extends parallel to the first engagement axis A1. As shown in FIGS. 3 and 4, an engagement feature 75 may be disposed between the ribs 73. The engagement feature 75 may extend outward from the body 58 in a direction perpendicular to the ribs 73 and may include an inclined surface 77 and a latch surface 79. An included angle between the inclined surface 77 and the latch surface 79 can be less than or equal to about ninety degrees, for example.

With reference to FIG. 3, the second terminals 36 can be female terminals of the type sold by Yazaki North America, Inc. under the model number 7114-4141-02, for example, or any other suitable terminal. The second terminals 36 may be electrically conductive members including a first end 72, a second end 74, and a notch 76 disposed between the first and second ends 72, 74. The first end 72 of each second terminal 36 may be electrically coupled to a corresponding one of the second insulated wires 22 for electrical communication therebetween. The second terminals 36 may be received in the receptacles 66 such that the barbed portion 70 of each lock arm 68 engages the notch 76 of the corresponding terminal 36 via a snap fit to fixedly but releasably couple the second terminals 36 to the body 58. The second end 74 of the second terminals 36 may include an aperture 78. The aperture 78 of each second terminal 36 may be adapted to slidably receive the second end 54 of a corresponding one of the first terminals 32 such that the first terminals 32 can be slid into and electrically engage the second ends 74 of the second terminals 36.

As shown in FIG. 3, the second connector assembly 24 can include a third connector 80, one or more third terminals 82, a fourth connector 84, and one or more fourth terminals 86. The third and fourth connectors 80, 84 may be disposed along a second engagement axis A2, which may be parallel to the first engagement axis A1, and may engage each other by a snap or press fit, for example.

The third connector 80 can be a male signal connector such as a YES/YESC Kaizen Connector sold by Yazaki North America, Inc. under the model number 7286-3915-30, for example, or any other suitable connector. The third connector 80 may be formed from a thermoplastic material, for example, and may include a body 88 having a first end 90 and a second end 92. The body 88 may include a recess 94 extending from the second end 92 toward the first end 90. One or more receptacles 96 may extend through the body 88 in a direction substantially parallel to the second engagement axis A2 from the first end 90 to the recess 94. Each receptacle 96 may be partially defined by a resiliently flexible lock arm 98 having a barbed portion 100.

The third terminals 82 can be male terminals of the type sold by Yazaki North America, Inc. under the model number 7114-4102-02, for example, or any other suitable terminal. The third terminals 82 may be electrically conductive members including a first end 102, a second end 104, and a notch 106 disposed between the first and second ends 102, 104. The first end 102 of each third terminal 82 may be electrically coupled to a corresponding one of the third insulated wires 26 for electrical communication therebetween. The third terminals 82 may be received in the receptacles 96 such that the barbed portion 100 of each lock arm 98 engages the notch 106 of the corresponding terminal 82 via a snap fit. The second end 104 of the third terminals 82 may extend out of the receptacles 96 into the recess 94.

The fourth connector 84 can be a female signal connector such as a YES/YESC Kaizen Connector sold by Yazaki North America, Inc. under the model number 7287-1598-30, for example, or any other suitable connector. The fourth connector 84 may be formed from a thermoplastic material, for example, and may include a body 108 having a first end 110 and a second end 112. The body 108 may include a recess 114 extending from the second end 112 toward the first end 110. One or more receptacles 116 may extend through the body 108 in a direction substantially parallel to the second engagement axis A2 from the first end 110 through to the recess 114. Each receptacle 116 may be partially defined by a resiliently flexible lock arm 118 having a barbed portion 120.

Figure 2:
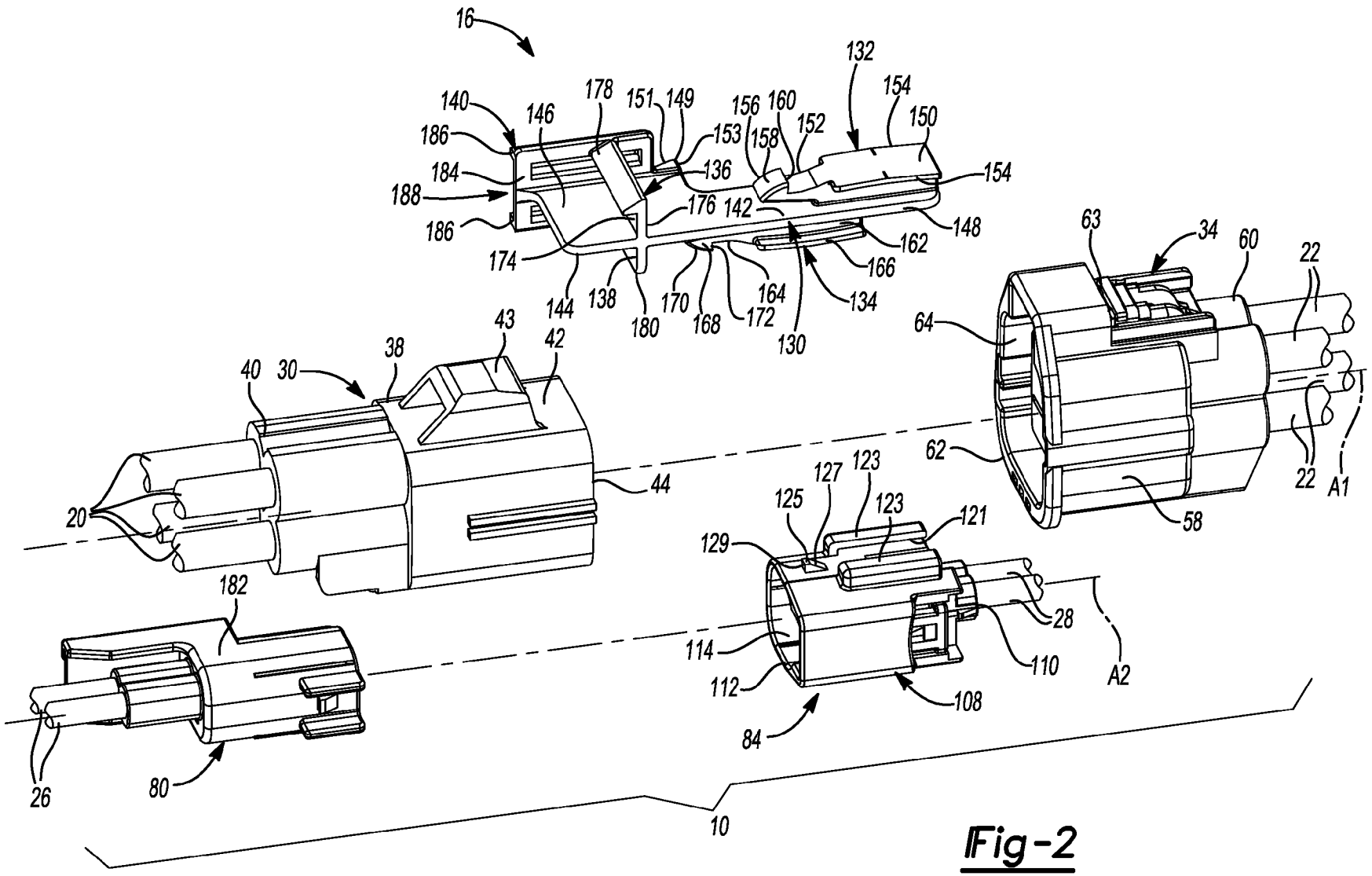
FIG. 2 is an exploded perspective view of the assembly of FIG. 1.

As shown in FIGS. 1 and 2, the body 108 of the fourth connector 84 may also include a pair of ribs 123 and an engagement feature 125. The ribs 123 may extend parallel to each other and parallel to the second engagement axis A2. A slot 121 (shown in FIGS. 2 and 5) extending parallel to the second engagement axis A2 may be formed in each of the ribs 123. The engagement feature 125 may be disposed generally between the second end 112 and the ribs 123. The engagement feature 125 may extend outward from the body 108 in a direction perpendicular to the second engagement axis A2 and may include an inclined surface 127 and a latch surface 129. As shown in FIGS. 2 and 3, an included angle between the inclined surface 127 and the latch surface 129 can be less than or equal to about ninety degrees, for example.

With reference to FIG. 3, the fourth terminals 86 can be female terminals of the type sold by Yazaki North America, Inc. under the model number 7116-4102-02, for example, or any other suitable terminal. The fourth terminals 86 may be electrically conductive members including a first end 122, a second end 124, and a notch 126 disposed between the first and second ends 122, 124. The first end 122 of each fourth terminal 86 may be electrically coupled to a corresponding one of the fourth insulated wires 28 for electrical communication therebetween. The fourth terminals 86 may be received in the receptacles 116 such that the barbed portion 120 of each lock arm 118 engages the notch 126 of the corresponding terminal 86. The second end 124 of the fourth terminals 86 may include an aperture 128. The aperture 128 of each fourth terminal 86 may be adapted to slidably receive the second end 104 of a corresponding one of the third terminals 82 such that the third terminals 82 can be slid into and electrically engaged with the fourth terminals 86.

With reference to FIG. 2, the staged-release member 16 can be molded from a thermoplastic material, for example, and may include a body 130, a first engagement member 132, a second engagement member 134, a first stop member 136, a second stop member 138, and a retaining portion 140. The body 130 may be a thin and flat elongated member having first and second sides 142, 144 and first and second portions 146, 148. The first portion 146 may include a barb 149 having an inclined surface 151 and a latch surface 153. An included angle between the inclined surface 151 and the latch surface 153 may be less than or equal to ninety degrees. The body 130 may be relatively rigid, yet resiliently flexible so that the second portion 148 of the body 130 can be repeatedly bent between a connector-retaining position (shown in FIGS. 7 and 8) and a connector-releasing position (shown in FIGS. 9 and 10).

The first engagement member 132 may include a base portion 150 and an engagement arm 152. The base portion 150 may extend outward from the first side 142 of the body 130 along the second portion 148 of the body 130. The base portion 150 may have a generally T-shaped profile (as shown in FIG. 5) including a pair of flanges 154 that extend outward from the base portion 150 and parallel to each other. The engagement arm 152 may extend from the base portion 150 toward the first portion 146 of the body 130 and may be cantilevered above the first side 142 of the body 130. The engagement arm 152 may be resiliently flexible and may include a barbed distal end 156 having an inclined surface 158 and a latch surface 160. The latch surface 160 may face away from the first portion 146 of the body 130. As shown in FIG. 4, an included angle between the inclined surface 158 and the latch surface 160 can be less than or equal to about ninety degrees, for example.

As shown in FIGS. 2 and 4, the second engagement member 134 may include a base portion 162 and an engagement arm 164. The base portion 162 may extend outward from the second side 144 of the body 130 along the second portion 148 of the body 130. The base portion 162 may have a generally T-shaped profile (as shown in FIG. 5) including a pair of flanges 166 that extend outward from the base portion 162 and parallel to each other (best shown in FIG. 5). The engagement arm 164 may extend from the base portion 162 toward the first portion 146 of the body 130 and may be cantilevered from the base portion 162 such that the engagement arm 164 is spaced apart from the second side 144 of the body 130 (as shown in FIG. 4). The engagement arm 164 may be resiliently flexible and may include a barbed distal end 168 having an inclined surface 170 and a latch surface 172. The latch surface 172 may face away from the first portion 146 of the body 130. As shown in FIGS. 3 and 4, an included angle between the inclined surface 170 and the latch surface 172 can be less than or equal to about ninety degrees, for example.

The first stop member 136 may be integrally formed with the first portion 146 and the retaining portion 140 and may extend from the first side 142 of the body 130 in a direction perpendicular to the engagement axes A1, A2. The first stop member 136 may include a first side 174 and a second side 176. The first stop member 136 can include a flange 178 integrally formed with the first side 174 and the retaining portion 140 to provide additional rigidity for the first stop member 136.

The second stop member 138 may be integrally formed with the first portion 146 and the retaining portion 140 and may extend from the second side 144 of the body 130 in a direction perpendicular to the engagement axes A1, A2 and opposite the first stop member 136. The second stop member 138 can be aligned with the first stop member 136 and may include a distal end 180.

Figure 6:
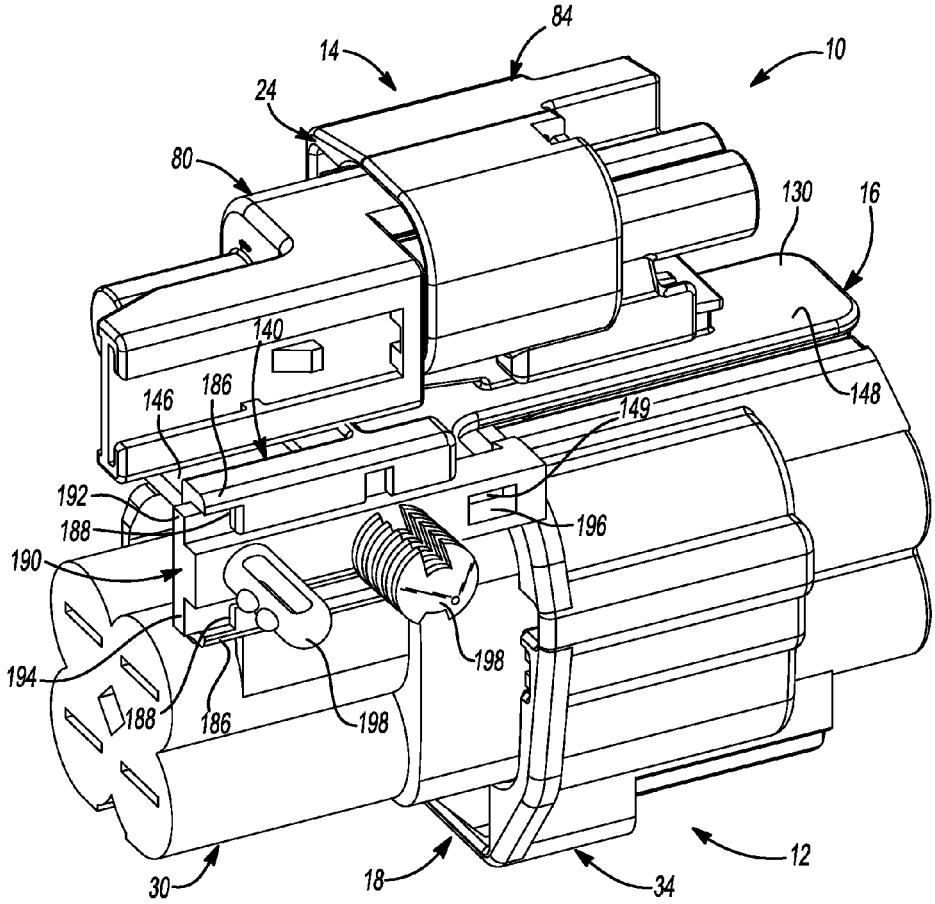
FIG. 6 is a perspective view of a portion of the assembly of FIG. 1, illustrating the staged-release member engaging a retainer.

With reference to FIGS. 2 and 6, the retaining portion 140 may include a body portion 184 and a pair of ribs 186. The body portion 184 may be perpendicular to the body 130 and the first and second stop members 136, 138. The ribs 186 may extend from the body portion 184 and may be spaced apart from each other and parallel to each other. A slot 188 may be formed in each of the ribs 186.

With reference to FIGS. 4 and 5, the base portion 150 may be slidably received between the ribs 73 of the second connector 34 such that the flanges 154 are received in the slots 71 formed in the ribs 73 (as shown in FIG. 5). As the first engagement member 132 is slid between the ribs 73 toward the second end 62 of the second connector 34 in a direction parallel to the first engagement axis A1, the inclined surface 158 of the first engagement member 132 may slide along the inclined surface 77 of the engagement feature 75 of the second connector 34, which may cause the engagement arm 152 to flex toward the first side 142 of the body 130. When the base portion 150 is fully received between the ribs 73, the engagement arm 152 may snap back into the position shown in FIGS. 3 and 4, whereby the barbed distal end 156 is engaged with the engagement feature 75 of the second connector 34. In this position, the latch surface 160 of the barbed distal end 156 may abut the latch surface 79 of the engagement feature 75. In this manner, the staged-release member 16 and the second connector 34 may be securely retained to each other.

With reference to FIGS. 2, 4, and 5, the base portion 162 may be slidably received between the ribs 123 of the fourth connector 84 such that the flanges 166 are received in the slots 121 formed in the ribs 123. As the second engagement member 134 is slid between the ribs 123 toward the second end 112 of the fourth connector 84 in a direction parallel to the second engagement axis A2, the inclined surface 170 of the second engagement member 134 may slide along the inclined surface 127 of the engagement feature 125 of the fourth connector 84, which may cause the engagement arm 164 to flex toward the second side 144 of the body 130. When the base portion 162 is fully received between the ribs 123, the engagement arm 164 may snap back into the position shown in FIGS. 3 and 4, whereby the barbed distal end 168 is engaged with the engagement feature 125 of the fourth connector 84. In this position, the latch surface 172 of the barbed distal end 168 may abut the latch surface 129 of the engagement feature 125. In this manner, the staged-release member 16 may be securely retained to the fourth connector 84, and the fourth connector 84 may be securely retained to the second connector 34.

As shown in FIG. 6, the retaining portion 140 can slidably engage a retainer 190. The retainer 190 may include first and second legs 192, 194, an aperture 196, and one or more fastening members 198. The fastening members 198 may be adapted to engage a structure (not shown) such as a vehicle into which the assembly 10 is incorporated. The retaining portion 140 may slidably engage the retainer 190 such that first and second legs 192, 194 of the retainer 190 are received in the slots 188. The barb 149 extending from the body 130 may engage an aperture 196 of the retaining portion 140 via a snap fit such that the latch surface 153 (shown in FIG. 2) of the barb 149 abuts a mating surface of the aperture 196. In this manner, the barb 149 and the retaining portion 140 may cooperate to engage the retainer 190, thereby securing the assembly 10 to the retainer 190 and the structure.

Figure 7:
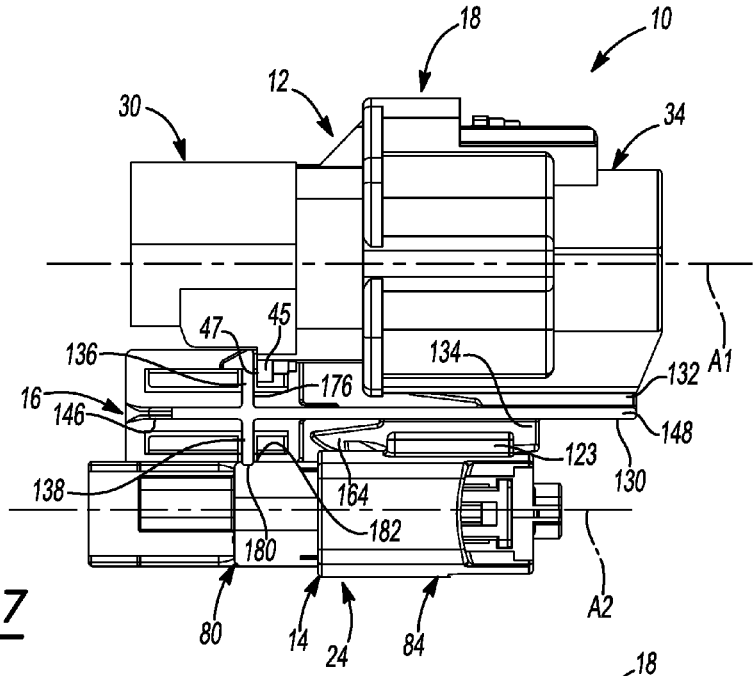
FIG. 7 is a side view of the portion of the assembly shown in FIG. 6 in an assembled condition.

With reference to FIGS. 1 and 7, the assembly 10 can be placed in the fully assembled condition by snap fitting the first and second engagement members 132, 134 to the second and fourth connectors 34, 84, respectively, in the manner described above. The staged-release member 16 can be bent or resiliently deflected into the connector-releasing position (shown in FIG. 9) to provide clearance for the first connector 30 to move along the first engagement axis A1 into engagement with the second connector 34. Once the first and second connectors 30, 34 are fully engaged with each other, the staged-release member 16 can be bent back or released to resiliently return to the connector-retaining position (shown in FIGS. 1 and 7). When the staged-release member 16 is in the connector-retaining position (e.g., FIGS. 7, and 8), the second side 176 may abut the abutment surface 47 of the lip member 45 of the first connector 30. With the staged-release member 16 in the connector-retaining position, there is sufficient clearance for the third connector 80 to move along the second engagement axis A2 into engagement with the fourth connector 84. When the staged-release member 16 is in the connector-retaining position and the assembly 10 is in a fully assembled condition (e.g., FIGS. 1, 3, and 7), the distal end 180 of the second stop member 138 may abut a surface 182 of the body 88 of the third connector 80.

With reference to FIGS. 7-10, once the assembly 10 has been placed in the fully assembled condition (shown in FIG. 7) and a user wants to disconnect one or both of the first and second connections 12, 14, the staged-release member 16 may control the disassembly process such that the second connection 14 is disconnected prior to before disconnecting the first connection 12. Such a configuration may be advantageous in an embodiment where the first connection 12 is a power connection and the second connection 14 is a signal connection, and it is desirable to disconnect the signal connection before disconnecting the power connection to prevent or reduce a potential for electrical arcing between the first and second connectors 30, 34 of the power connection in some situations. Accordingly, the assembly 10 may be disconnected in stages, including a first stage (shown in FIG. 8), a second stage (shown in FIG. 9), and a third stage (shown in FIG. 10).

As described above, when the assembly 10 is in the fully assembled condition (FIG. 7), the first and second engagement members 132, 134 may be engaged with the second and fourth connectors 34, 84, respectively, the first stop member 136 may abut the lip member 45 of the first connector 30, and the second stop member 138 may abut the surface 182 of the third connector 80. The engagement between the first stop member 136 and the lip member 45 prevents the first connector 30 from being moved along the first engagement axis A1 away from the second connector 34 to disconnect the first and second connectors 30, 34 from each other. The engagement between the second stop member 138 and the surface 182 of the third connector 80 prevents the body 130 of the staged-release member 16 from being bent into the connector-releasing position (shown in FIGS. 9 and 10).

Figure 8:
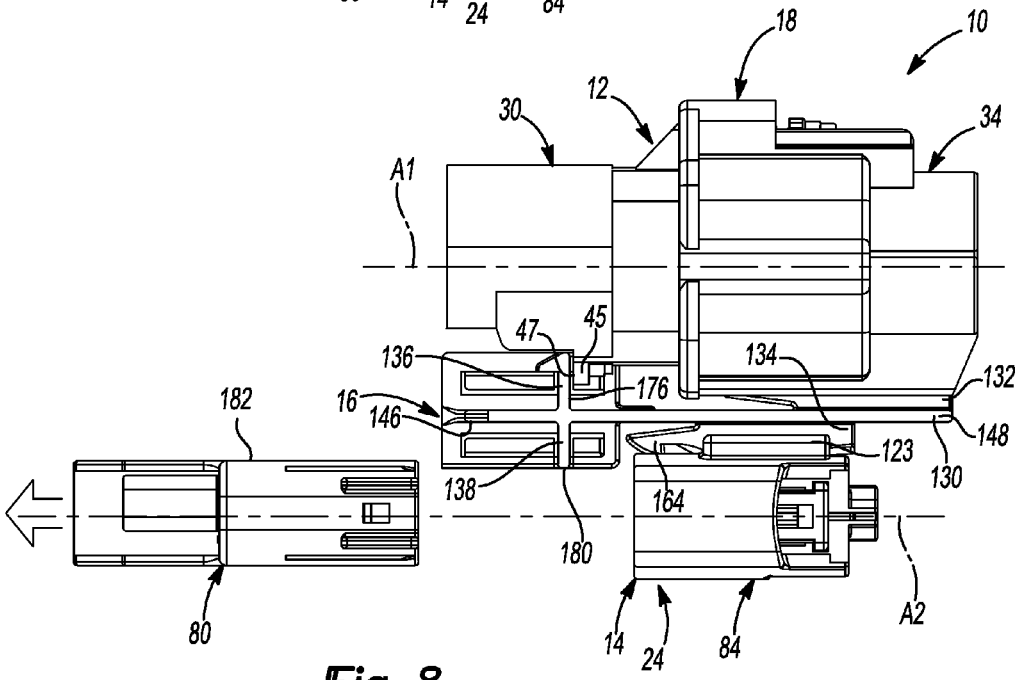
FIG. 8 is a side view of the portion of the assembly in a first disassembly stage, in which a connector is disconnected from the rest of the assembly and the staged-release member is in a connector-retaining position.

As shown in FIG. 8, in a first disconnection stage, the third connector 80 may be disconnected from the fourth connector 84 by moving the third connector 80 away from the fourth connector 84 along the second engagement axis A2. The third connector 80 may be moved away from the staged-release member 16 such that the second stop member 138 is no longer engaged with the third connector 80, and movement of the staged-release member 16 between the connector-retaining position and the connector-releasing position is no longer restricted by the third connector 80.

Figure 9:
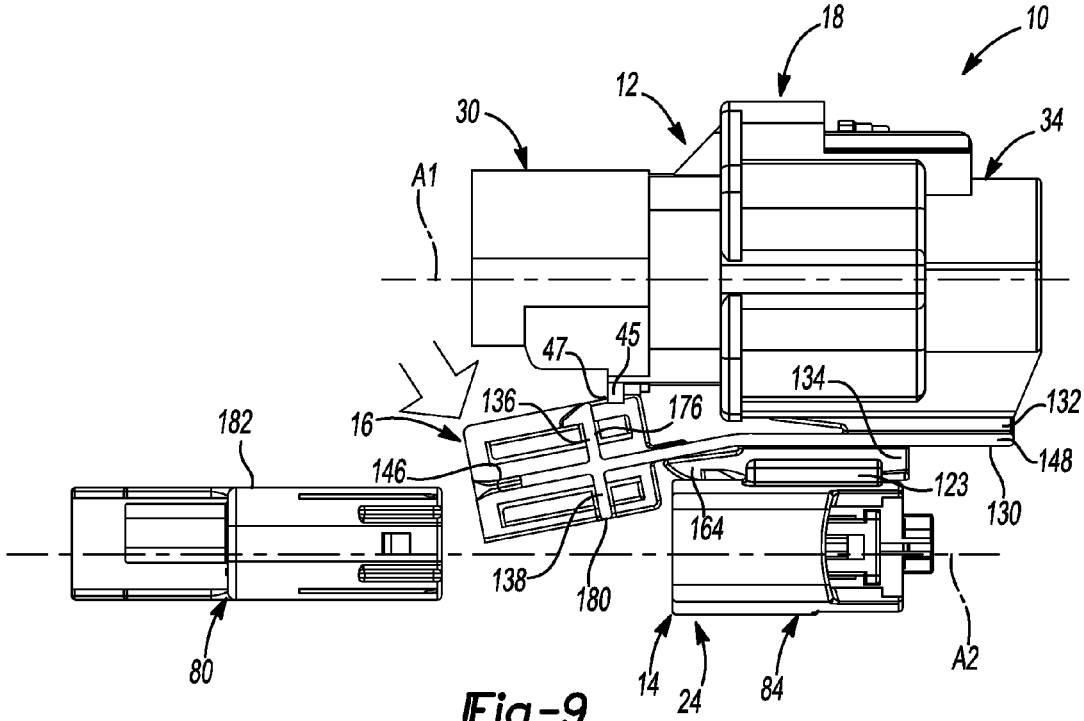
FIG. 9 is a side view of the portion of the assembly in a second disassembly stage, in which the staged-release member is in a connector-releasing position.
Figure 10:
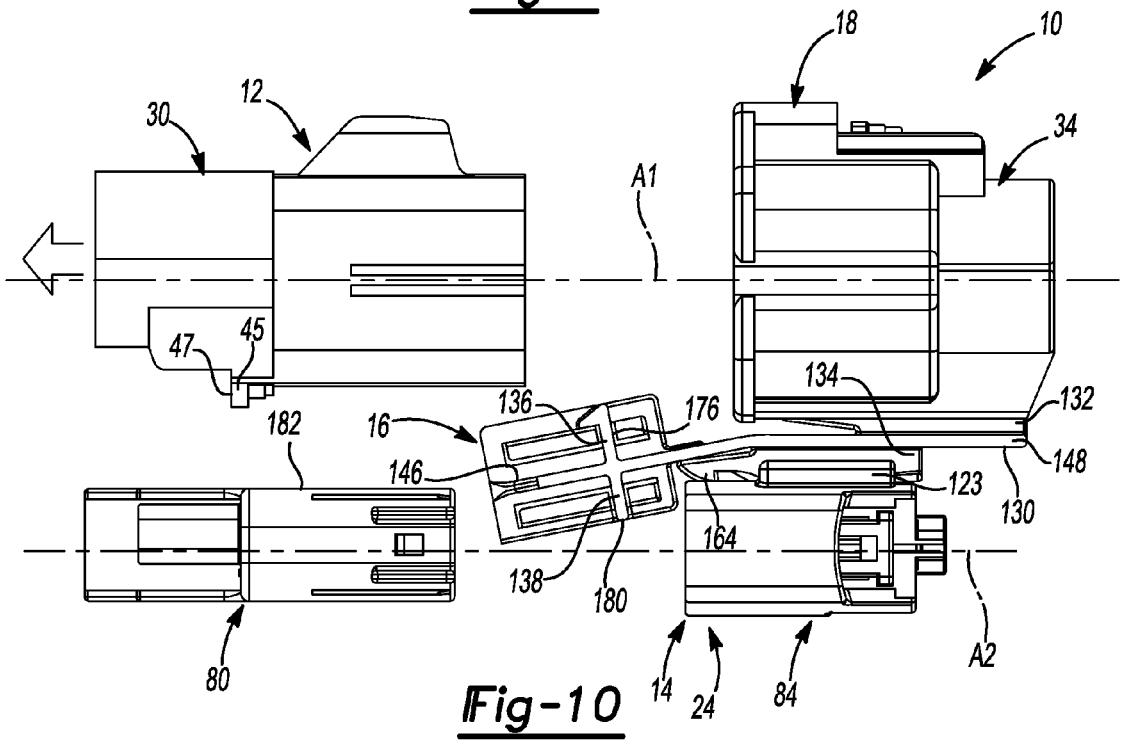
FIG. 10 is a side view of the portion of the assembly in a third disassembly stage, in which another connector is disconnected from the rest of the assembly.

As shown in FIG. 9, in a second disconnection stage, the body 130 of the staged-release member 16 may be bent into the connector-releasing position. That is, the first portion 146 of the body 130 may be bent downward relative to the second portion 148 and the first, second and fourth connectors 30, 34, 84. With the staged-release member 16 in the connector-releasing position, the first stop member 136 is spaced apart from the lip member 45 of the first connector 30 and provides clearance for the lip member 45 in a direction parallel to the first engagement axis A1. Therefore, when the staged-release member 16 is in the connector-releasing position, the first connector 30 can be moved into the third disconnection stage (shown in FIG. 10). That is, the first connector 30 can be moved away from the second connector 34 along the first engagement axis A1 to disconnect the first connector 30 from the second connector 34, as shown in FIG. 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a first connector;

a second connector configured to matingly engage the first connector;

a third connector;

a fourth connector configured to matingly engage the third connector; and a staged-release member including first and second portions, the first portion being secured relative to the first and third connectors, the second portion being movable relative to the first portion between a first position restricting axial separation of the second connector from the first connector and a second position allowing axial separation of the second connector from the first connector, wherein the fourth connector restricts movement of the second portion from the first position to the second position while the fourth connector is matingly engaged with the third connector.

2. The assembly of claim 1, wherein the staged-release member allows axial separation of the fourth connector from the third connector while the second portion is in the first position.

3. The assembly of claim 1, wherein the second portion of the staged-release member is movable relative to the first portion of the staged-release member independently of relative movement between the first and second connectors.

4. The assembly of claim 1, wherein the first portion removably engages the first and third connectors.

5. The assembly of claim 4, wherein the first portion includes first and second integrally formed retaining members removably engaging the first and third connectors via snap fits.

6. The assembly of claim 1, wherein the first and second connectors are movable relative to each other along an engagement axis to selectively engage and disengage each other while the second portion is in the second position, and wherein the second portion of the staged-release member includes a stop member that extends perpendicular to the engagement axis while the second portion is in the first position.

7. The assembly of claim 6, wherein the second connector includes a lip extending perpendicular to the engagement axis, and the stop member abuts the lip while the second portion is in the first position to restrict relative movement between the first and second connectors along the engagement axis.

8. The assembly of claim 6, wherein a surface of the fourth connector engages the stop member while the fourth connector is engaged with the third member to restrict relative movement between the first and second portions of the staged-release member.

9. The assembly of claim 8, wherein the surface of the fourth connector extends parallel to the engagement axis.

10. The assembly of claim 1, wherein the first and second connectors are power connectors and the third and fourth connectors are signal connectors.

11. The assembly of claim 1, wherein the staged-release member is resiliently bendable to allow the second portion to move relative to the first portion between the first and second positions.

12. A device for ensuring a sequenced disconnection of an electrical connector assembly including first and second connectors adapted to engage third and fourth connectors, respectively, the device comprising:

a first portion including a body and first and second engagement features extending from the body, the first and second engagement features being adapted to removably engage the first and second connectors, respectively; and a second portion connected to the first portion and including a first stop member and a second stop member, the first stop member being movable relative to the first portion between a first position restricting axial separation of the third connector from the first connector and a second position allowing axial separation of the third connector from the first connector, the second stop member being configured to restrict movement of the first stop member from the first position to the second position while the fourth connector is matingly engaged with the second connector.

13. The device of claim 12, wherein the second portion allows axial separation of the fourth connector from the second connector while the first stop member is in the first position.

14. The device of claim 12, wherein the first and third connectors are movable relative to each other along an engagement axis to selectively engage and disengage each other while the first stop member is in the second position, and wherein the first stop member extends perpendicular to the engagement axis in the first position.

15. The device of claim 14, wherein the third connector includes a lip extending perpendicular to the engagement axis, and the first stop member abuts the lip in the first position to restrict relative movement between the first and third connectors along the engagement axis.

16. The device of claim 15, wherein a surface of the fourth connector engages the second stop member while the fourth connector is engaged with the second member to restrict relative movement of the first stop member relative to the first portion of the device.

17. A method comprising:

coupling first and second connectors to facilitate electrical communication between first and second electrical conductors housed within the first and second connectors, respectively;

coupling third and fourth connectors to facilitate electrical communication between third and fourth electrical conductors housed within the third and fourth connectors, respectively;

coupling a staged-release member to the first and third connectors;

axially separating the fourth connector from the third connector;

moving at least a portion of the staged-release member relative to the second connector from a first position to a second position after axially separating the fourth connector from the third connector; and axially separating the second connector from the first connector after moving at least the portion of the staged-release member to the second position.

18. The method of claim 17, wherein moving at least the portion of the staged-release member relative to the second connector includes moving a first portion of the staged-release member relative to a second portion of the staged-release member.

19. The method of claim 18, wherein moving the first portion of the staged-release member relative to the second portion includes bending the first portion relative to the second portion.

20. The method of claim 19, wherein moving the first portion to the second position includes moving a stop member away from a lip extending from the second connector.

21. The method of claim 17, further comprising restricting movement of at least the portion of the staged-release member relative to the second connector before axially separating the fourth connector from the third connector.

22. The method of claim 17, wherein coupling the staged-release member to the first and third connectors includes engaging first and second engagement features with the first and third connectors, respectively, via a snap fit.

* * * * *